US006631936B2

(12) United States Patent
Brinkmann et al.

(10) Patent No.: US 6,631,936 B2
(45) Date of Patent: Oct. 14, 2003

(54) IDLER WHEEL AXLE FOR RAIL VEHICLES

(75) Inventors: Andreas Brinkmann, Oberhausen (DE); Thomas Timmermann, Ratingen (DE); Thaddäus Kasprzyk, Dorsten (DE); Bernd Wienkopf, Bochum (DE)

(73) Assignee: Gutehoffnungshutte Radsatz GmbH, Oberhausen (DE)

( * ) Notice: Subject to any disclaimer, the term of this patent is extended or adjusted under 35 U.S.C. 154(b) by 0 days.

(21) Appl. No.: 09/886,969

(22) Filed: Jun. 21, 2001

(65) Prior Publication Data

US 2002/0083862 A1 Jul. 4, 2002

(51) Int. Cl.[7] ..... B60B 37/10; B60B 37/12; B60B 35/00; B61D 1/00; B61F 11/00

(52) U.S. Cl. ..... 295/44; 295/42.1; 105/180

(58) Field of Search ..... 295/1, 3, 7, 15, 295/31.1, 36.1, 42.1, 44; 301/137; 105/218.1, 218.2, 157.1, 180

(56) References Cited

U.S. PATENT DOCUMENTS 2,543,930 A * 3/1951 Pachter ..... 105/180
3,802,352 A * 4/1974 Keller ..... 105/181
3,888,187 A * 6/1975 Van Moss, Jr. ..... 105/221.2
3,939,779 A * 2/1976 Pringle ..... 105/180
4,064,809 A * 12/1977 Mulcahy ..... 105/167
6,079,335 A * 6/2000 Polley ..... 105/218.2

FOREIGN PATENT DOCUMENTS

| | | |
|---|---|---|
| DE | 4445407 | 12/1994 |
| EP | 0183619 | 6/1986 |
| EP | 0911239 | 4/1999 |
| EP | 0943519 | 9/1999 |
| WO | 9824674 | 10/1997 |

* cited by examiner

*Primary Examiner*—S. Joseph Morano
*Assistant Examiner*—Jason R. Bellinger
(74) *Attorney, Agent, or Firm*—Price, Heneveld, Cooper, DeWitt & Litton

(57) ABSTRACT

An idler wheel axle for single-axle or double-axle chassis of rail vehicles having individually mounted wheels and U-shaped, dropped-framed vehicles with lateral carrying legs, wherein each wheel is rotatably mounted on the inside of the associated carrying leg, and on an axle stub of the carrying leg via a wheel mounting, and wherein each wheel is torsionally connected on an inside thereof to a shaft that extends outward through orifices within the wheel and the carrying leg.

18 Claims, 3 Drawing Sheets

IDLER WHEEL AXLE FOR RAIL VEHICLES

BACKGROUND OF THE INVENTION

The present invention relates to an idler wheel axle, and more specifically to an idle wheel axle assembly for individually mounted wheels.

An idler wheel axle is described in WO 98/24674. This known idler wheel axle is designed in actual fact as a driven axle, a drive being fastened to the outside of the chassis frame on each longitudinal side of the chassis. By virtue of a primary suspension provided between the carrying frame and a chassis frame carrying the drive, the drive is connected to the wheel via a cardanic double coupling. In this case, a first drive-side coupling plane is arranged on the outside of the drive and a second driven-side coupling plane lies directly on the inside of the wheel. The shaft, thereby functioning as a cardan shaft, runs continuously, with a corresponding length, between the two coupling planes of the cardanic double coupling. The advantage of this known idler wheel axle is that the axle and the drive can have a small construction width, in order, for example, to make it possible to have even narrow-gage vehicles, at the same time with a small car body width, without the chassis projecting in a disturbing way. A further advantage is that the mounting of the wheel is arranged within the latter, with the result that a good load-bearing capacity and a long useful life are achieved. This solution has a disadvantage, however, when it is necessary to have a maximum central-aisle width (as is customary, for example, in dropped-frame cars) limited only by the spacing of the wheels and necessary transverse-spring travels and transverse-spring free spaces, since this central-aisle width is restricted by the coupling plane arranged on the inside of the wheel. The fact that access to wheel components, such as, for example, the wheel mounting, for maintenance work is impeded by the coupling plane may likewise be a disadvantage. Moreover, in the case of adaption to further, for example even smaller gages, virtually the entire construction would have to be changed.

DE 44 29 889 A1 describes another chassis, in which the wheels, together with the outside drive, are arranged externally on the frame. Here, too, the wheels are connected to the drive in each case via a cardanic double coupling, but the driven-side coupling plane lies directly on the outside of the wheel and the wheel carrying frame is arranged between the insides of the two wheels of an axle. Adaption to different, in particular smaller gages consequently presents a particular problem.

In the applicant's previous German patent application DE 199 30 424.6, it was proposed, on the basis of WO 98/24674, that the shaft terminate in a coupling plane formed directly on the outside of the carrying leg. This results in particularly high variability in application, especially with regard to adaption to smaller gages, while at the same time preserving the advantage of an optimum design of the wheel mounting by the latter being arranged within the wheel. Maintenance work is also made easier. To adapt the axle to a different, for example smaller gage (for example, 900 mm), it is necessary merely for the length of the wheel-carrying axle stub of the carrying leg and of the shaft to be adapted to the desired wheel position corresponding to the gage. As regards a driven axle, however, all the drive components can be left unchanged, because the shaft then forms an intermediate drive shaft which is connected to an actual drive shaft in the coupling plane. As a result, a version, such as is known from the abovementioned DE 44 29 889 A1, may be used as a drive unit. All the advantages according to WO 98/24674 are nevertheless maintained. Furthermore, in the case of a nondriven axle, the shaft may be utilized as a braking shaft by being connected to a braking device in the coupling plane.

Moreover, in the proposed idler wheel axle according to DE 199 30 424.6, this provision, in addition to the wheel mounting arranged completely with two part bearings within the orifice of the wheel, for the shaft to be mounted in the orifice of the carrying leg via a further rotary bearing which therefore, as a whole, forms a third part bearing. However, in order to avoid tolerance-related errors of alignment between the three part bearings, this version is highly complicated in manufacturing terms.

SUMMARY OF THE INVENTION

The object on which the present invention is based is to provide such an idler wheel axle, by means of which, while the remaining advantages described are preserved, optimized stability, particularly in the region of the wheel mounting, is achieved at a low outlay in manufacturing terms.

This is achieved, according to the invention, in that the wheel mounting consists of (only) two part bearings, and the first part bearing is arranged within the orifice of the wheel radially between the latter and the axle stub of the carrying leg, while the second part bearing is arranged, offset axially and radially to the first, within the orifice of the carrying leg radially between the latter and the shaft.

This advantageous configuration affords the appreciable advantage that the part bearings, of which only two are provided, can be brought into alignment in a substantially simpler way. This is a "divided" wheel mounting, the first part bearing being arranged, as before, within the wheel, that is to say in that region of the wheel orifice which is defined by the axial width or thickness of said wheel. According to the invention, the second part bearing has been displaced axially into the region in which the third part bearing was provided in the proposed idler wheel axle. There is therefore virtually a "fusion" of two part bearings. As a result, the wheel, together with the shaft, forms virtually a unit which is mounted in its entirety via the two part bearings arranged so as to be offset axially, while a bearing load-bearing capacity and therefore useful bearing life which are optimum in the existing construction space are achieved.

Further advantageous design features of the invention are contained in the subclaims and the following description.

DESCRIPTION OF THE DRAWINGS

The invention will be explained in more detail with reference to preferred exemplary embodiments and examples of use illustrated in the drawing in which.

DETAILED DESCRIPTION OF THE PREFERRED EMBODIMENTS

Figure 1:
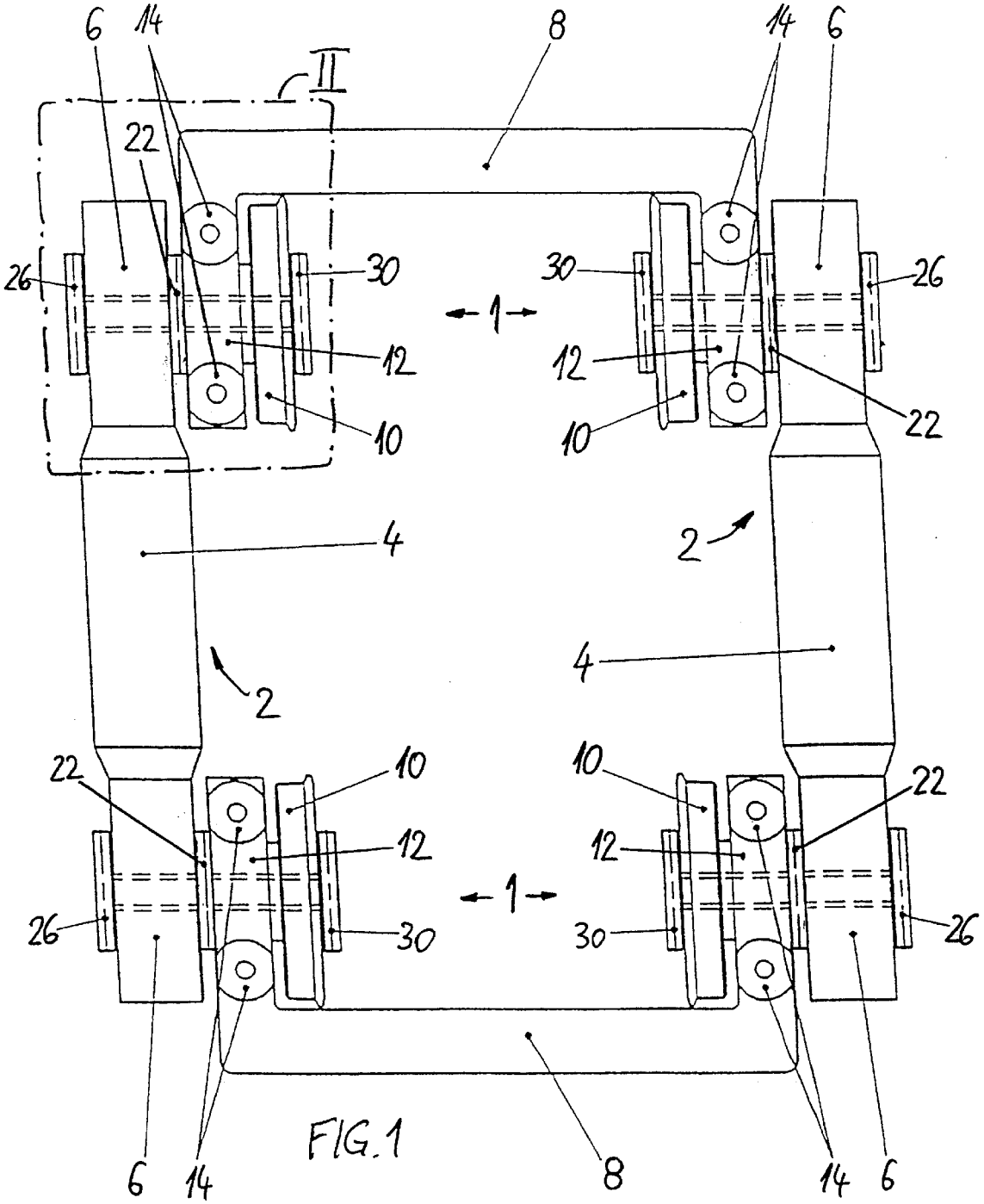
FIG. 1 shows a highly diagrammatic top view of a double-axle chassis with two here, for example, driven idler wheel axles according to the invention.

FIG. 1 first illustrates by way of example a use of two idler wheel axles 1 according to the invention in a driven double-axle chassis. In this case, on each longitudinal side of the chassis, there is a drive unit 2 which consists of an electric motor 4 and of bevel-wheel gears 6 flanged on both sides. Each axle has a U-shaped wheel carrying frame 8 which is also known as a gantry axle. Wheels 10 are mounted individually on the wheel carrying frame 8, the wheel-carrying frame 8 externally surrounding the wheels with lateral carrying legs 12, and each wheel being articulated rotatably on the inside of the associated carrying leg 12. Each drive unit 2 is suspended on a chassis frame, not illustrated, which is supported on the respective wheel carrying frame 8 via a primary suspension. For this purpose, the wheel carrying frame 8 has, in particular in the region of the carrying legs 12, bearing surfaces 14 for primary spring elements.

Figure 2:
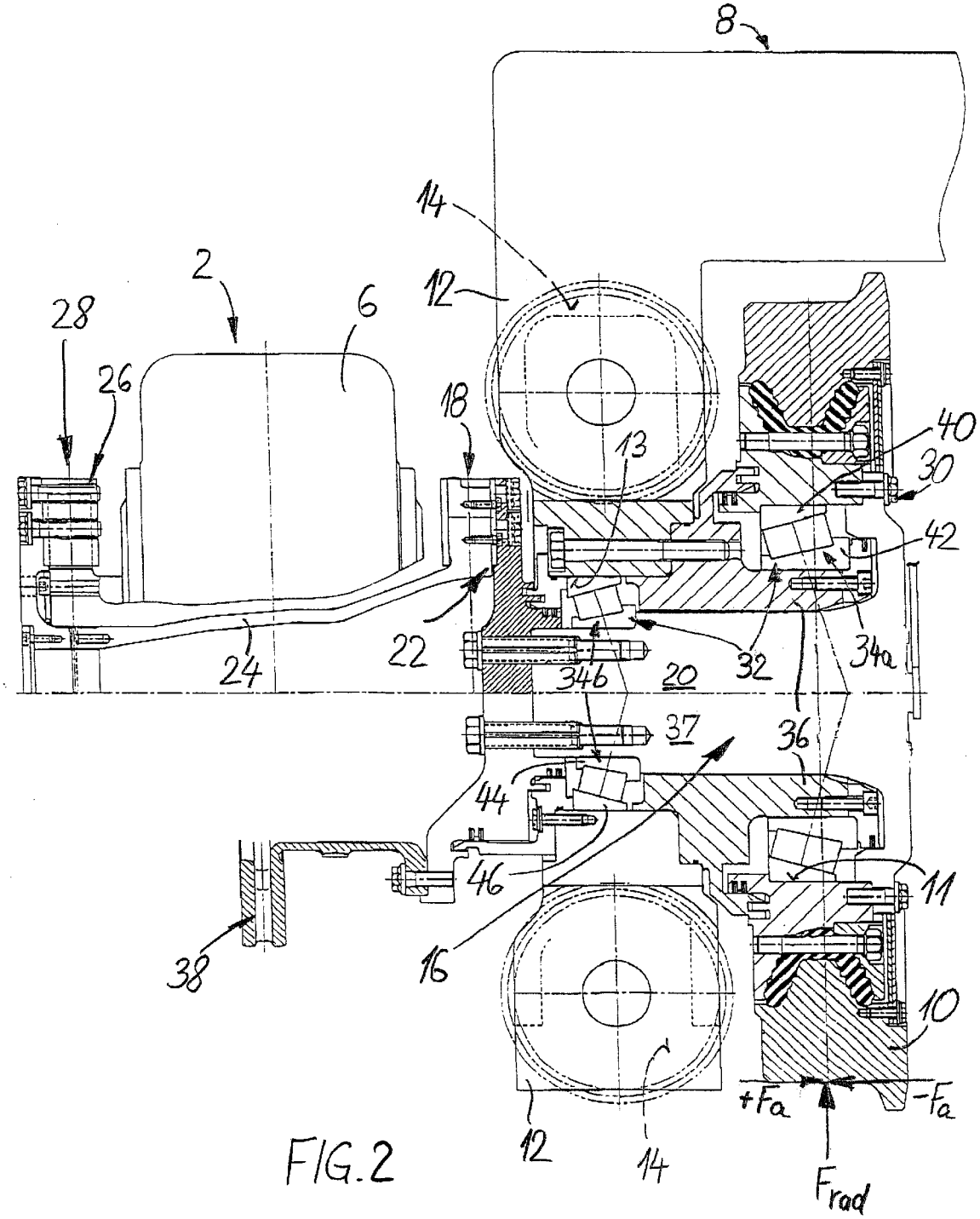
FIG. 2 shows the area II from FIG. 1 in an enlarged, more detailed sectional view, two different variants of use being illustrated in the upper and the lower half of the figure.

As may be gathered from FIG. 2, then, each wheel 10 is torsionally connected on its inside to a shaft 16 which extends outward through orifices 11 and 13 of the wheel 10 and of the carrying leg 12. This shaft 16 terminates preferably in a connecting plane 18 formed directly on the outside of the carrying leg 12. Preferably, the shaft 16 is rigidly connected on its inside to the wheel 10 via a connecting element 30, so that the shaft 16 rotates coaxially with the wheel 10.

According to the invention, for the rotary mounting of the wheel 10 or of the unit (wheel/shaft unit) formed from the wheel 10 and the shaft 16 as a result of their rigid connection, a wheel mounting 32 is provided, which consists of (only) two part bearings 34*a* and 34*b*. The first part bearing 34*a* is arranged within the wheel 10, that is to say in that region of its orifice 11 which is defined by its axial width, that is to say radially between the wheel 10 and an axle stub 36 of the carrying leg 12, said axle stub engaging into the wheel. The second part bearing 34*b* is arranged, offset axially and radially to the first part bearing 34*a*, within the orifice 13 of the carrying leg 12 radially between the latter and the shaft 16. This configuration according to the invention shows optimum bearing stress and therefore a high stability of the bearings. Further particulars of the wheel mounting 32 according to the invention will be explained in more detail further below.

In the example of the use of a driven idler wheel axle 1, as illustrated in the upper half of FIG. 2, the shaft 16 forms an intermediate drive shaft 20 which is connected in the connecting plane 18, via a coupling 22, to an actual drive shaft 24 of the drive unit 2. The drive shaft 24 is connected on its other opposite side, via a further coupling 26, to the gear 6 of the drive 2. In the preferred configuration, the drive shaft 24 is designed as a preferably hollow cardan shaft which is essentially coaxial in the prolongation of the intermediate shaft 20 and the two couplings 22 and 26 located on both sides are designed as a cardanic double coupling. In this case, the drive shaft 24 runs through the gear 6, so that a drive-side coupling plane 28 lies on the outside, pointing away from the carrying frame 8, of the gear 6 or of the drive 2, while the driven-side connecting plane 18 and the coupling 22 lie between the gear 6 and the carrying leg 12 of the carrying frame 8 (cf., in this respect, also FIG. 1).

Each coupling 22, 26 consists, in a way known per se, of star-shaped coupling pieces which engage one into the other, with elastic wedge-like compensating elements being interposed. As a result, they allow a cardanic compensation of suspension movements of an order of magnitude of at least approximately ±15 mm.

In contrast to the version according to FIG. 2, the shaft 16 connected to the wheel 10 may also extend continuously, in one piece, as far as the drive 2 or the coupling 26 (coupling plane 28) located on the outside there.

The embodiment and form of use of the idler wheel axle 1 according to the invention, as illustrated in the lower half of FIG. 2, is a non-driven version. In this case, the drive units 2, together with electric motors 4 and the gears 6, including the drive shafts 24, are dispensed with. Instead, each shaft 16 may then advantageously be utilized as a braking shaft 37 by being connected to a braking device in the connecting plane 18. In this alternative, the braking device is designed preferably as a disk brake, the shaft 16 having connected to it a brake disk 38, so that the latter rotates jointly with the wheel 10. The brake disk 38 cooperates with a brake caliper, not illustrated, supported on the carrying leg 12 of the wheel carrying frame 8. The connecting plane 18 of this version which is non-driven, but instead has braking capacity, does not have to coincide exactly with the position of the connecting plane 18 of the driven version according to FIG. 2.

Figure 3:
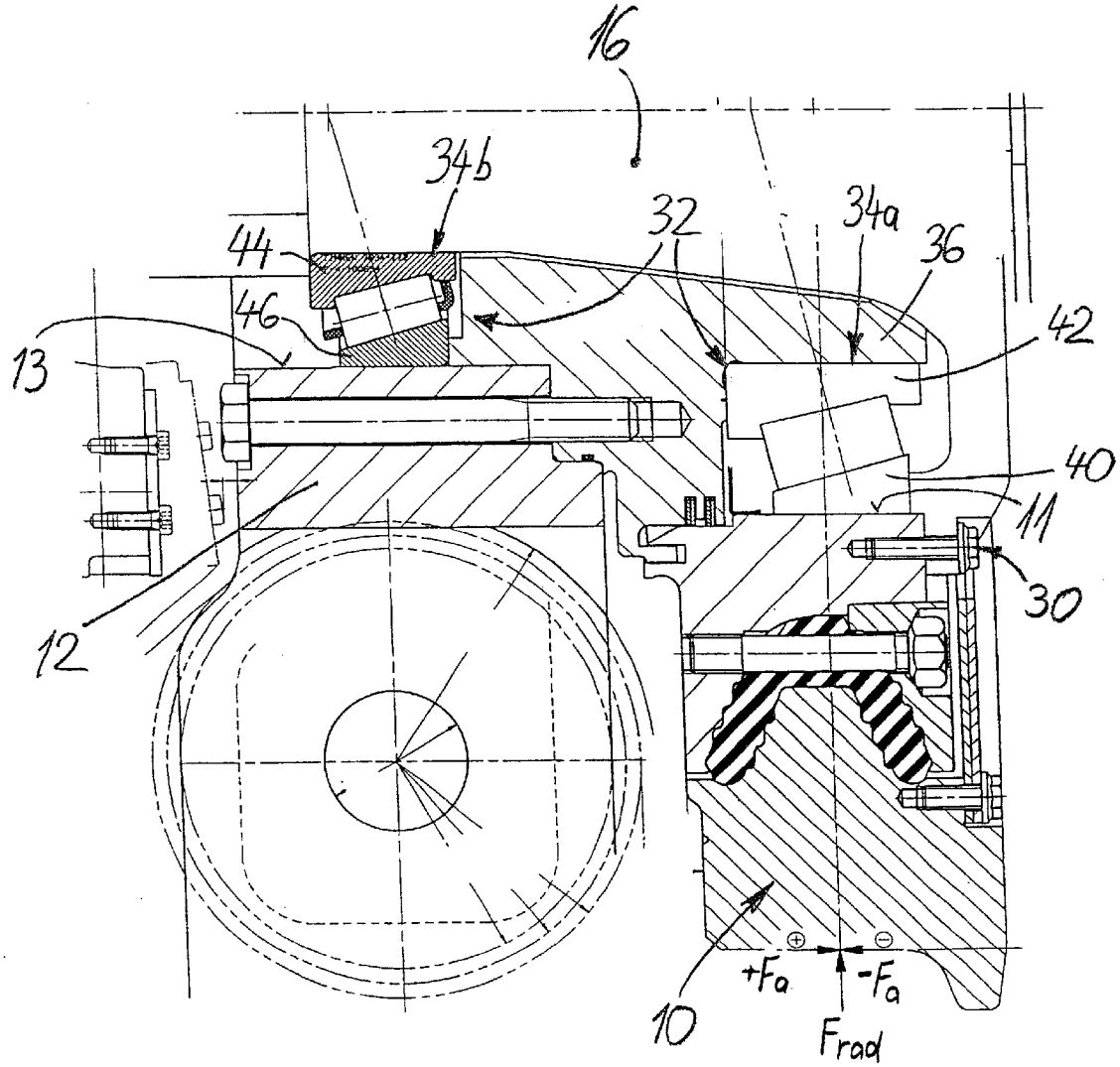
FIG. 3 shows a design variant of the wheel mounting in a half section similar to that of FIG. 2.

The wheel mounting 32 according to the invention will be explained in even more detail below. By virtue of the two part bearings 34*a*, 34*b* being arranged according to the invention, in the first place, the first part bearing 34*a* has an outer ring 40 seated in the orifice 11 of the wheel 10 and therefore rotating together with the wheel 10 and an inner ring 42 seated nonrotatably on the axle stub 36. Furthermore, the second part bearing 34*b* has an inner ring 44 rotating with the shaft 16 and an outer ring 46 seated non-rotatably in the orifice 13 of the carrying leg 12. The two part bearings 34*a*, 34*b* are in this case designed preferably as tapered roller bearings for the absorption of radial forces $F_{rad}$ and also of axial forces $+F_a$ and $-F_a$ acting in the two axially opposite directions. Since, according to the invention, the part bearings 34*a*, 34*b* are arranged, "reversed", with respect to their rotating or non-rotating outer/inner rings, the result of this, when tapered roller bearings are used, is that, for supporting both axial forces, the conical surfaces of the two part bearings 34*a*, 34*b* do not, in purely geometric terms, run at an opposite inclination to one another, as is otherwise customary, but, instead, as seen axially, run at an inclination going in the same direction (mirroring of the effective direction of force). In a view from the inside of the wheel in the direction of the outside (from right to left in FIGS. 2 and 3), the conical surfaces of the bearing rings may either narrow according to FIG. 2 or widen according to FIG. 3. The choice between the two alternatives depends on the forces occurring during the respective application. As a rule, the version according to FIG. 2 is to be preferred.

In conclusion, the advantages of the idler wheel axle described will be summarized as follows:

(1) drive components always the same, regardless of the respective gage (2) a long service life of the wheel mounting due to an optimum arrangement of the two part bearings, regardless of the respective gage (3) adaption to different gages, with the drive maintained, possible solely by the adaption of the intermediate drive shaft and wheel suspension (4) high variability of application, thus also for a non-driven axle with wheels braked via the wheel shaft.

The invention is not restricted to the exemplary embodiments illustrated and described, but also embraces all the versions having the same effect within the meaning of the invention. Moreover, the invention has hitherto also not yet been restricted to the feature combination defined in claim 1, but may also be defined by any other combination of specific features of all the individual features disclosed as a whole. This means that, in principle, virtually any individual feature of claim 1 may be omitted or be replaced by at least one individual feature disclosed elsewhere in the application. To that extent, claim 1 is to be understood merely as a first attempt at the formulation of an invention.

What is claimed is:

1. An idler wheel axle with individually mounted wheels for chassis of rail vehicles, with a wheel carrying frame externally surrounding the wheels with lateral carrying legs, each wheel being rotatably mounted on the inside of the associated carrying leg, each wheel mounted on an axle stub of the carrying leg by a wheel mounting, and each wheel being torsionally connected on an inside of the wheel to a shaft which extends outward through orifices of the wheel and of the carrying leg, the wheel mounting consisting of two part bearings, and the first part bearing being arranged within the orifice of the wheel between the wheel and the axle stub of the carrying leg, while the second part bearing is arranged, offset axially and radially to the first, within the orifice of the carrying leg between the carrying leg and the shaft.

2. The idler wheel axle of claim 1, wherein the first part bearing has an outer ring rotating with the wheel and an inner ring seated non-rotatably on the axle stub.

3. The idler wheel axle of claim 1, wherein the second part bearing has an inner ring rotating with the shaft and an outer ring seated non-rotatably in the orifice of the carrying leg.

4. The idler wheel axle of claim 1, wherein the two part bearings are designed as tapered rollers bearing for the absorption of radial forces ($F_{rad}$) and also of axial forces ($+F_a$, $-F_a$) acting in the two axially opposite directions.

5. The idler wheel axle of claim 4, wherein the inner and outer rings of the two part bearings include conical surfaces, and wherein the conical surfaces narrow radially.

6. The idler wheel axle of claim 4, wherein the inner and outer rings of the two part bearings include conical surfaces, and wherein the conical surfaces widen radially.

7. The idler wheel axle of claim 1, wherein the shaft terminates in a connecting plane formed directly on the outside of the carrying leg.

8. The idler wheel axle of claim 7, wherein the shaft includes an intermediate drive shaft that is operably connected in the connecting plane to a drive shaft of a drive arranged externally on the longitudinal side of the chassis.

9. The idler wheel axle of claim 7, wherein the shaft forms a braking shaft and is connected to a braking device in the connecting plane.

10. The idler wheel axle of claim 9, wherein the braking devices includes a disk brake, and wherein the braking shaft is operably connected to a brake disk which cooperates with a brake caliper supported on the carrying leg.

11. An idler wheel axle assembly, comprising:

a plurality of wheels;

a wheel carrying frame having a plurality of wheel carrying legs, wherein the wheels are rotatably mounted to an inside of the wheel carrying legs such that the frame externally surrounds the wheels;

an axle stub operably connected to each of the wheel carrying legs of the frame by a wheel mounting; and a shaft torsionally connected to an inside of each wheel, the shaft extending outwardly through orifices of each wheel and orifices of each carrying leg;

wherein the wheel mounting includes a first part bearing and a second part bearing, the first part bearing arranged within the orifice of the wheel between the wheel and the axle stub, the second part bearing arranged within the orifice of the carrying leg between the carrying leg and the shaft, and offset axially and radially to the first part bearing, the first part bearing including an outer ring rotatable with respect to the axle stub and an inner ring seat non-rotatably with the axle stub, and wherein the second part bearing includes an inner ring rotatable with respect to the carrying leg and an outer ring seated non-rotatably in the orifice of the carrying leg.

12. The idler wheel axle assembly of claim 11, wherein the two part bearings are designed as tapered rollers bearing for the absorption of radial forces ($F_{rad}$) and also of axial forces ($+F_a$, $-F_a$) acting in the two axially opposite directions.

13. The idler wheel axle assembly of claim 12, wherein the inner and outer rings of the two part bearings include conical surfaces, and wherein the conical surfaces narrow radially.

14. The idler wheel axle assembly of claim 12, wherein the inner and outer rings of the two part bearings include conical surfaces, and wherein the conical surfaces widen radially.

15. The idler wheel axle assembly of claim 11, wherein the shaft terminates in a connecting plane formed directly on the outside of the carrying leg.

16. The idler wheel axle assembly of claim 15, wherein the shaft includes an intermediate drive shaft that is operably connected in the connecting plane to a drive shaft of a drive arranged externally on the longitudinal side of the chassis.

17. The idler wheel axle assembly of claim 15, wherein the shaft forms a braking shaft and is connected to a braking device in the connecting plane.

18. The idle wheel axle assembly of claim 17, wherein the braking device include a disk brake, and wherein the braking shaft is operably connected to a brake disk which cooperates with a brake caliper supported on the carrying leg.

* * * * *

UNITED STATES PATENT AND TRADEMARK OFFICE

CERTIFICATE OF CORRECTION

PATENT NO. : 6,631,936 B2
DATED : October 14, 2003
INVENTOR(S) : Brinkmann et al.

It is certified that error appears in the above-identified patent and that said Letters Patent is hereby corrected as shown below:

Column 1,
Line 7, “idle” should be -- idler --.

Column 5,
Line 31, “rollers bearing” should be -- roller bearings --.

Column 6,
Line 26, “rollers bearing” should be -- roller bearings --.
Line 48, “idle” should be -- idler --.

Signed and Sealed this

Twentieth Day of April, 2004

JON W. DUDAS
*Acting Director of the United States Patent and Trademark Office*